US008001619B1

(12) United States Patent
Baehring

(10) Patent No.: US 8,001,619 B1
(45) Date of Patent: Aug. 23, 2011

(54) LAPEL STIFFENER

(76) Inventor: Brady W. Baehring, Muskego, WI (US)

( * ) Notice: Subject to any disclaimer, the term of this patent is extended or adjusted under 35 U.S.C. 154(b) by 130 days.

(21) Appl. No.: 12/399,874

(22) Filed: Mar. 6, 2009

(51) Int. Cl.
*A41B 3/06* (2006.01)
*A41B 3/08* (2006.01)
*A41C 1/14* (2006.01)

(52) U.S. Cl. ..... 2/132; 2/258; 2/266

(58) Field of Classification Search ..... 2/132, 255, 2/256, 257, 258, 265, 266
See application file for complete search history.

(56) References Cited

U.S. PATENT DOCUMENTS 2,035,766 A * 3/1936 Schramm, Jr. ..... 428/196
2,401,157 A * 5/1946 Hirsch ..... 2/131
2,467,117 A * 4/1949 Dukes, Jr. ..... 2/120
2,595,133 A * 4/1952 Golden ..... 2/260.1
2,599,636 A * 6/1952 Hull ..... 2/132
2,627,605 A * 2/1953 Nichols ..... 2/132
2,740,125 A * 4/1956 Spevak ..... 2/132
2,795,795 A * 6/1957 Hobbs ..... 2/132
2,836,827 A * 6/1958 Montero ..... 2/132
2,884,640 A * 5/1959 Liebowitz ..... 2/132
6,089,422 A 7/2000 Gibson
D507,205 S 7/2005 Bier et al.
2005/0160520 A1* 7/2005 Forrest ..... 2/255
2009/0019619 A1* 1/2009 Shweky ..... 2/258
2009/0038049 A1 2/2009 West

* cited by examiner

*Primary Examiner* — Bobby Muromoto, Jr.
(74) *Attorney, Agent, or Firm* — Donald J. Ersler

(57) ABSTRACT

A lapel stiffener includes a stiffener strip and a peel-off label. A pressure sensitive adhesive is applied to one side of the stiffener strip. The peel-off label is applied over the pressure sensitive adhesive. The peel-off label is removed and the pressure sensitive adhesive is pressed on to an inside surface of a lapel. A second embodiment of the lapel stiffener includes the stiffener strip, a strip retainer pocket and a strip storage pocket. The strip retainer pocket is formed by securing a strip of material behind a lapel to receive the stiffener strip. The strip storage pocket is formed on a bottom of the lapel. A third embodiment of the lapel stiffener preferably includes the stiffener strip and a strip retainer cavity. The strip retainer cavity is formed by securing a strip of material behind a lapel. The strip retainer cavity surrounds the stiffener strip.

12 Claims, 6 Drawing Sheets

LAPEL STIFFENER

BACKGROUND OF THE INVENTION

1. Field of the Invention

The present invention relates generally to the appearance of open shirts and more specifically to a lapel stiffener, which allows a top unbuttoned garment to have a crisp appearance.

2. Discussion of the Prior Art

U.S. Pat. No. 6,089,422 to Gibson discloses a collar stiffening device and method. The Gibson patent includes a collar stiffening means comprising a base with two surfaces wherein the base has depicted upon one of its two surface one or more geometric shapes and upon the other its two surfaces, an adhesive with a removably affixed cover so that the adhesive side of the case can be pressed upon the underside of a collar for stiffening thereof. Design Pat. No. D507,205 to Bier et al. discloses a collar stay. Patent application no. 2009/0038049 to West discloses a collar stay device. The West patent application includes a stay body having a tapered first end and an expandable second end. The stay body includes first and second legs, which are integrally formed at the tapered first end and diverge toward the expandable second end. At least one of the legs includes a plurality of protrusions on an outer surface of a free end thereof.

Accordingly, there is a clearly felt need in the art for a lapel stiffener, which supports a portion of lapels located below the collar to provide a crisp appearance to a garment, such as a shirt, zippered sweater, jacket or fleece, when the buttons below the collar are unbuttoned or the zipper is pulled partially downward.

SUMMARY OF THE INVENTION

The present invention provides a lapel stiffener, which allows a top unbuttoned garment to have a crisp appearance. The lapel stiffener preferably includes a stiffener strip and a peel-off label. A pressure sensitive adhesive is applied to one side of the stiffener strip. The peel-off label is applied over the pressure sensitive adhesive. The stiffener strip has a width that is substantially the distance between an outside edge of a lapel and a button slit in the lapel of a shirt. A length of the stiffener strip is preferably the distance from the collar of the shirt to substantially a second button slit. In use, the peel-off label is removed from the stiffener strip and the pressure sensitive adhesive is pressed on to an inside surface of the lapel. The lapel stiffener is applied to both a button slit lapel and a button lapel of the shirt.

A second embodiment of the lapel stiffener preferably includes the stiffener strip, a strip retainer pocket and a strip storage pocket. The strip retainer pocket is preferably formed by sewing a strip of material behind a lapel of a shirt. The stiffener strip retainer pocket is sized to receive the stiffener strip. The strip retainer pocket is preferably formed from the collar to substantially a second button slit. The strip storage pocket is preferably formed on a bottom of the button lapel of the shirt to store the stiffener strips when not in use.

A third embodiment of the lapel stiffener preferably includes the stiffener strip and a strip retainer cavity. The strip retainer cavity is preferably formed by sewing a strip of material behind a lapel of a shirt. The strip retainer cavity is preferably formed a distance from the collar to substantially a second button slit. The stiffener strip cavity surrounds a perimeter of the stiffener strip. The strip retainer cavity is formed behind both lapels of the shirt. Button openings are formed through the stiffener strip, such that a button may be inserted through the button slit.

Accordingly, it is an object of the present invention to provide a lapel stiffener, which supports a portion of the lapels located below the collar to provide a crisp appearance to a garment such as a shirt, zippered sweater, jacket or fleece, when buttons below the collar are unbuttoned or the zipper is pulled partially downward.

These and additional objects, advantages, features and benefits of the present invention will become apparent from the following specification.

DETAILED DESCRIPTION OF THE PREFERRED EMBODIMENTS

Figure 1:
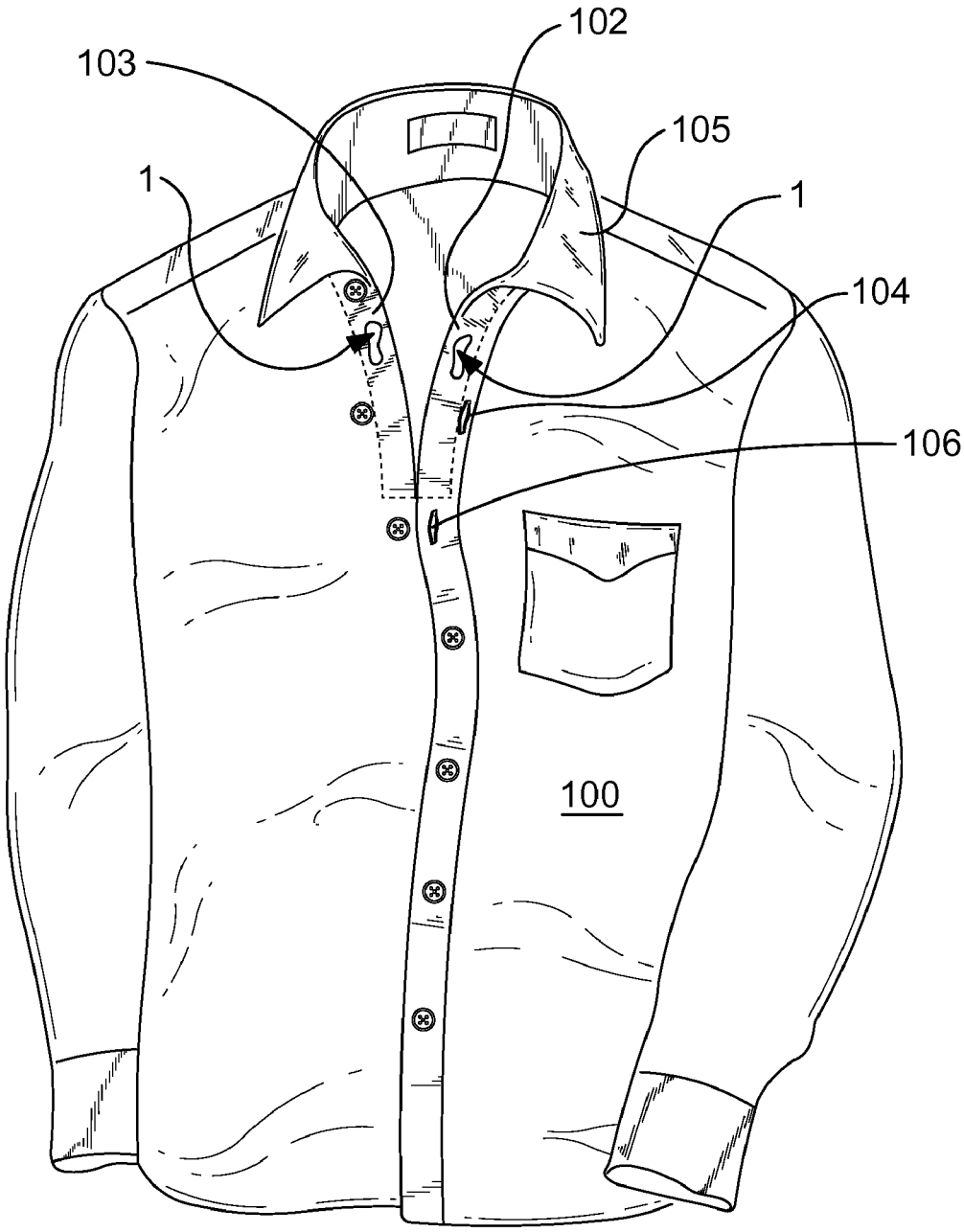
FIG. 1 is a perspective view of a shirt with a lapel stiffener applied thereto in accordance with the present invention.
Figure 2:
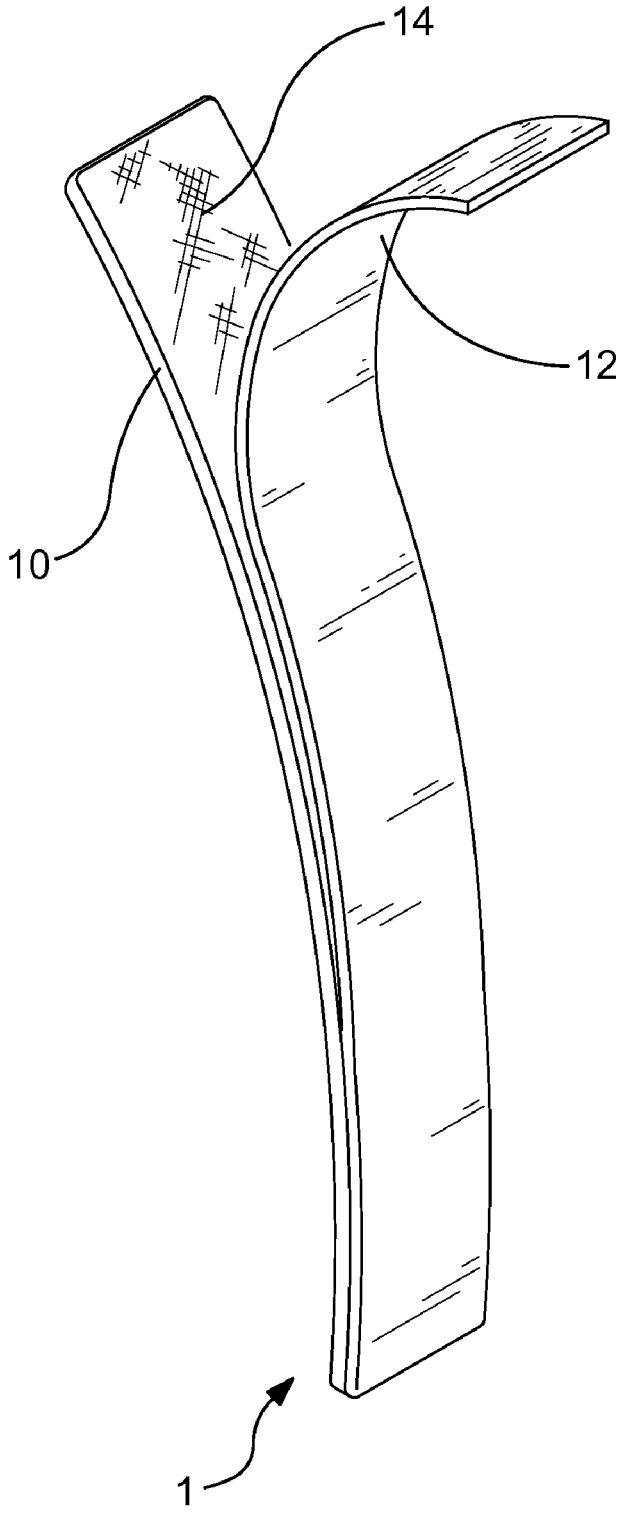
FIG. 2 is a perspective view of a lapel stiffener with a peel-off label partially removed in accordance with the present invention.

With reference now to the drawings, and particularly to FIG. 1, there is shown a perspective view of a shirt 100 with a lapel stiffener 1 applied thereto. With reference to FIG. 2, the lapel stiffener 1 includes a stiffener strip 10 and a peel-off label 12. A pressure sensitive adhesive 14 is applied to one side of the stiffener strip 10. The peel-off label 12 is applied over the pressure sensitive adhesive 14. The stiffener strip 10 is preferably fabricated from a stiff yet flexible material, such as a typical stay plastic. The stiffener strip 10 has a width that is substantially the distance between outside edge of a button slit lapel 102 and a button slit 104, 106 in the button slit lapel 102 of the shirt 100. A length of the stiffener strip is preferably the distance from a collar 105 of the shirt 100 to a second button slit 106. In use, the peel-off label 12 is removed from the stiffener strip 10 and the pressure sensitive adhesive 14 is pressed on to an inside surface of the button slit lapel 102 and a second stiffener strip 10 is applied to an inside surface of a button lapel 103 of the shirt 100.

Figure 3:
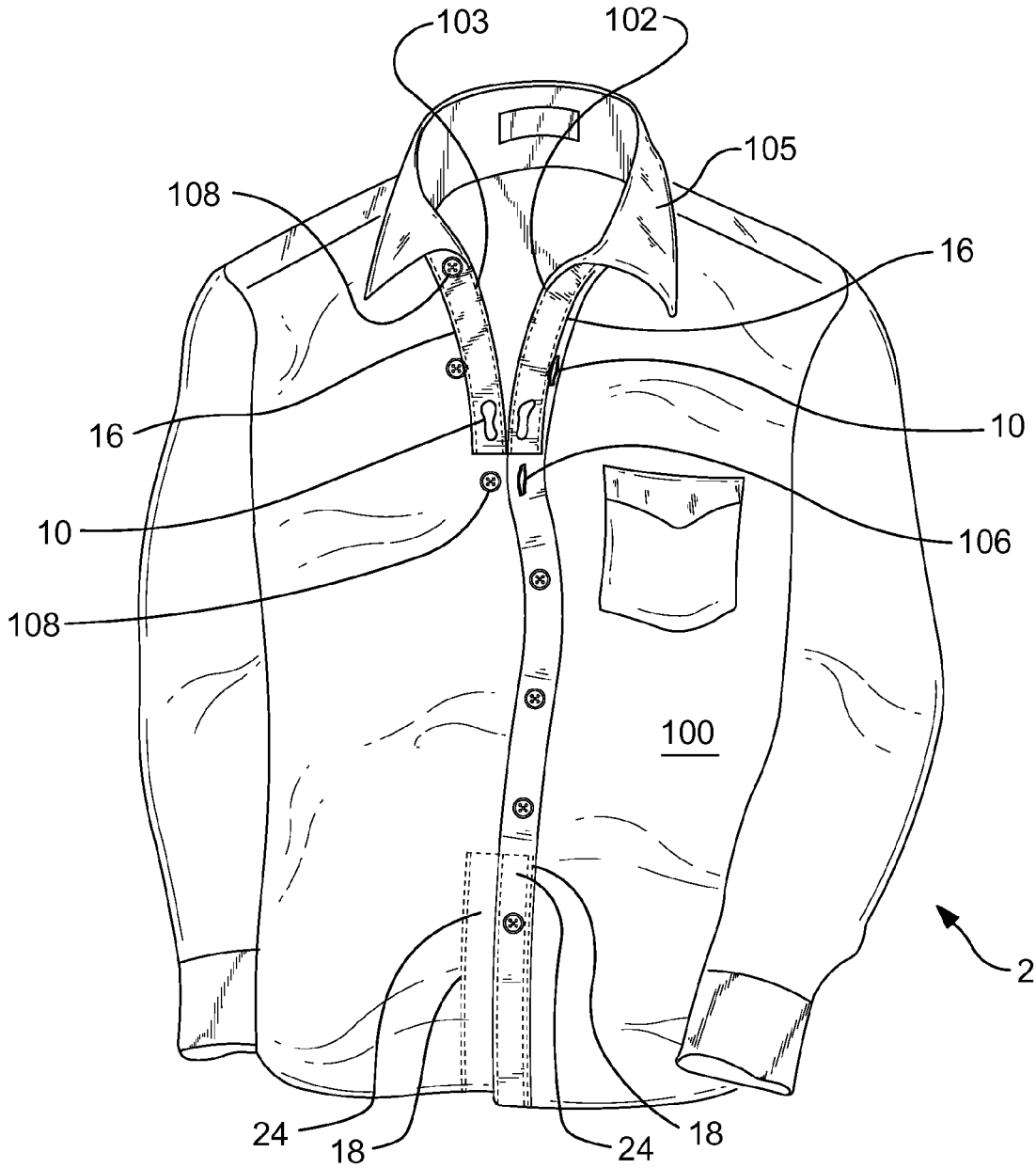
FIG. 3 is a perspective view of a shirt with a second embodiment of a lapel stiffener incorporated therein in accordance with the present invention.
Figure 4:
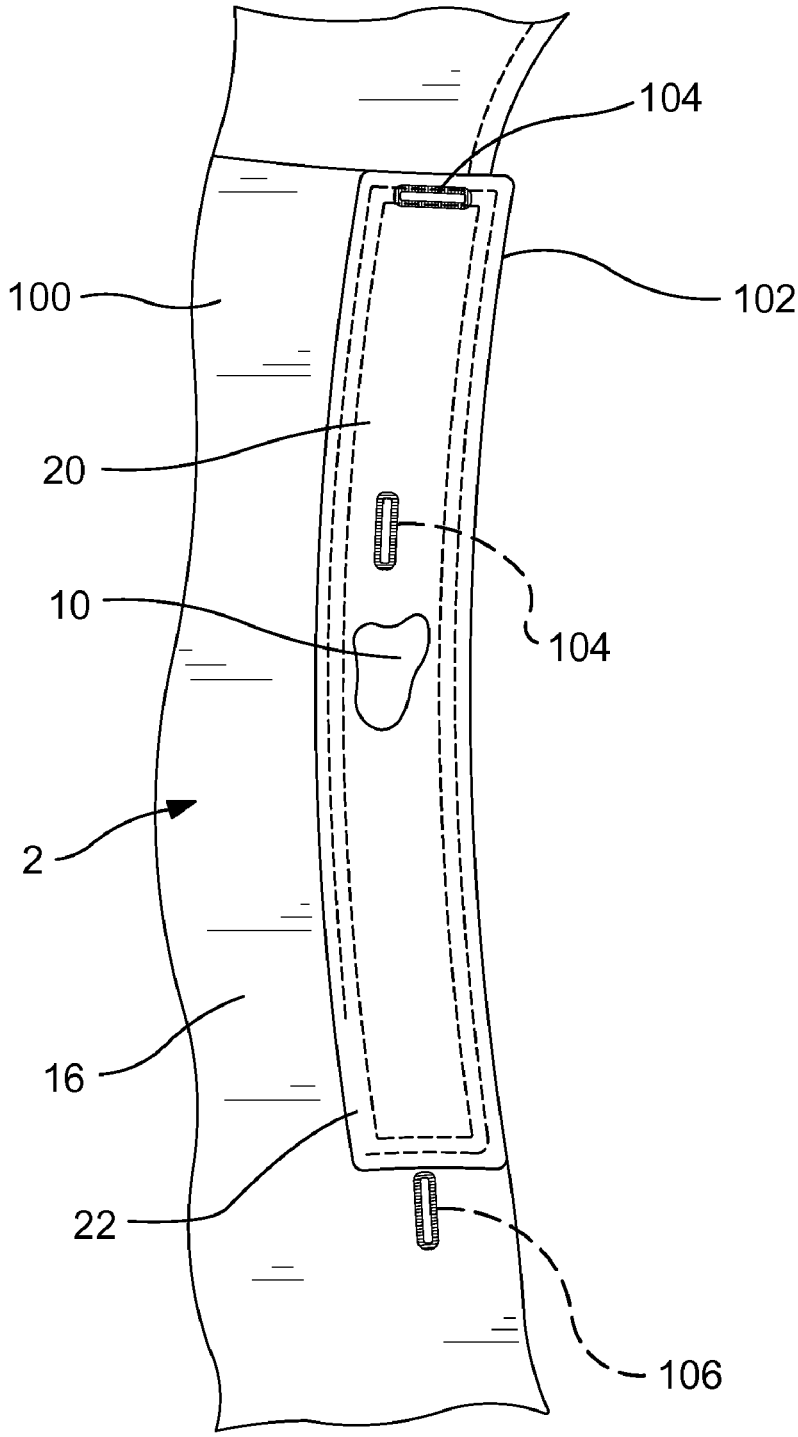
FIG. 4 is an enlarged rear view of a lapel with a second embodiment of a lapel stiffener incorporated therein in accordance with the present invention.

With reference to FIGS. 3-4, a second embodiment of the lapel stiffener 2 preferably includes the stiffener strip 10, a strip retainer pocket 16 and a strip storage pocket 18. The strip retainer pocket 16 is preferably formed by securing a strip of material 20 on an inside surface of the button slit lapel 102 and the button lapel 103 of the shirt 100. The strip retainer pocket 16 is sized to receive the stiffener strip by insertion through a pocket opening 22. The strip retainer pocket 16 is preferably formed from the collar 105 to substantially the second button slit 106. The strip of material 20 is preferably a fabric material. The strip of material 20 is preferably sewn to the lapels 102, 103, but could be attached with any appropriate method, such as adhesive or heat bonding.

The strip storage pocket 18 is preferably formed by securing the strip of material 20 to a bottom of the button lapel 103 and/or the button slit lapel 102. The strip storage pocket 18 stores at least one stiffener strip 10 from the strip retainer pockets 16. The at least one stiffener strip 10 is inserted into the strip storage pocket 18 through a pocket opening 24.

Figure 5:
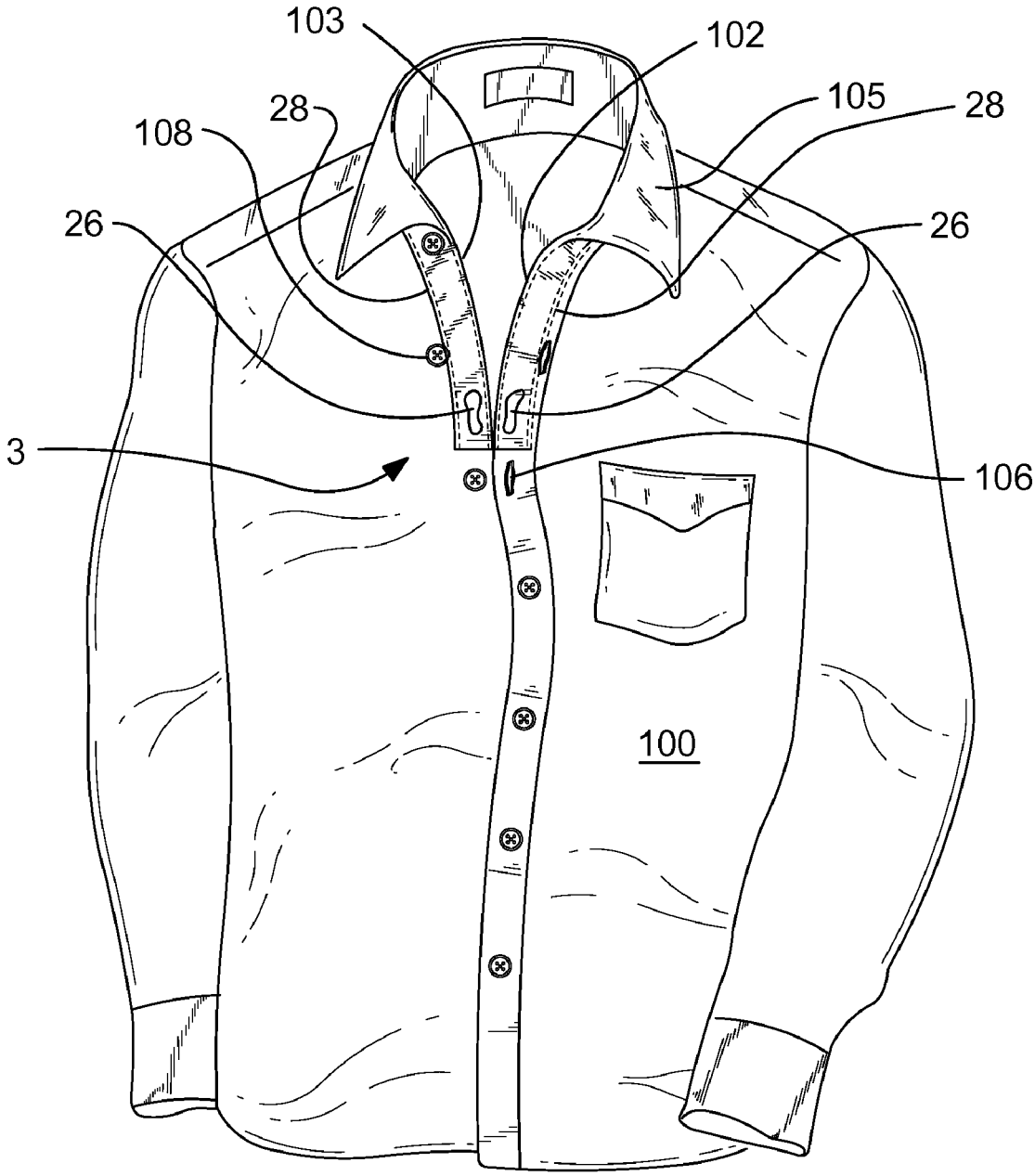
FIG. 5 is a perspective view of a shirt with a third embodiment of a lapel stiffener incorporated therein in accordance with the present invention.
Figure 6:
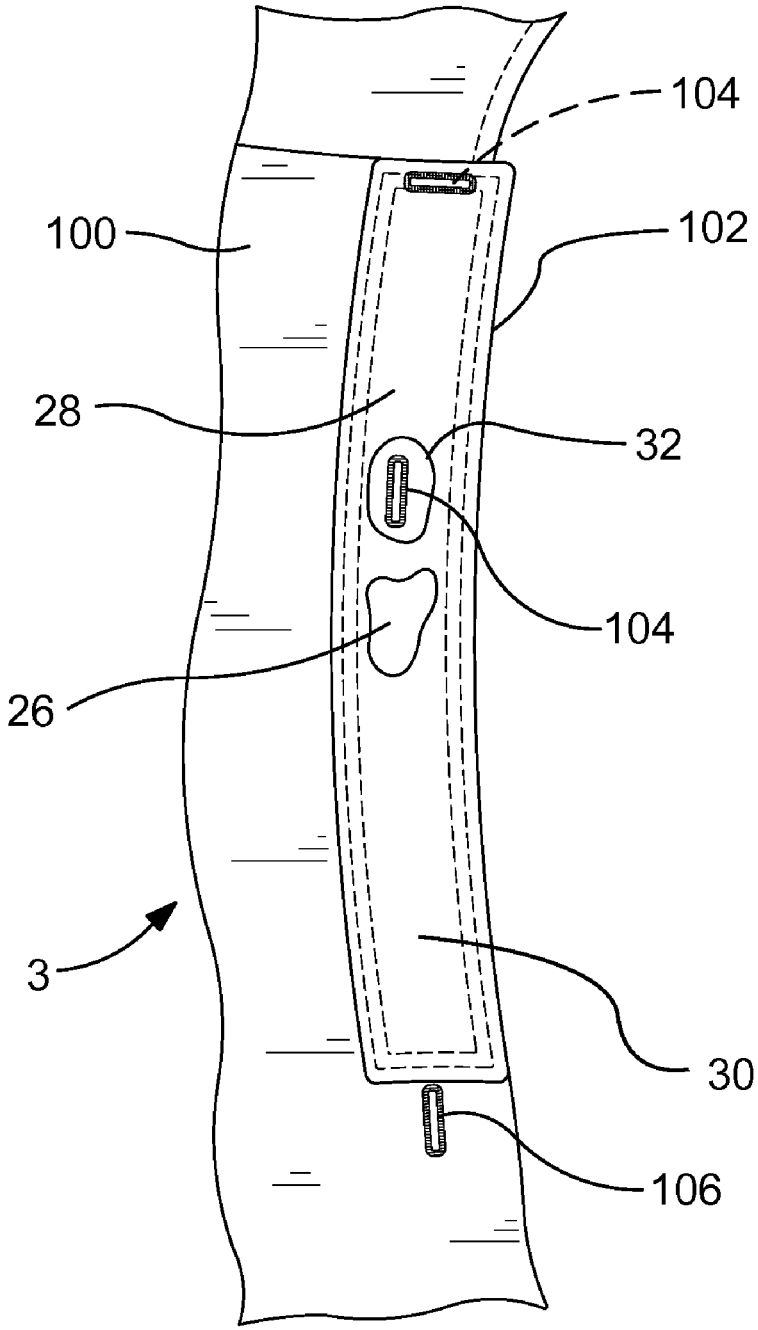
FIG. 6 is an enlarged rear view of a lapel shirt with a third embodiment of a lapel stiffener incorporated therein in accordance with the present invention.

With reference to FIGS. 5-6, a third embodiment of the lapel stiffener 3 preferably includes a stiffener strip 26 and a strip retainer cavity 28. The strip retainer cavity 28 is preferably formed by securing a strip of material 30 on an inside surface of the button slit lapel 102 and the button lapels 103 of the shirt 100 and around a perimeter of the stiffener strip 26. The strip retainer cavity 28 is preferably formed from the collar 105 to substantially the second button slit 106. The strip of material 30 is preferably a fabric material. The strip of material 30 is preferably sewn to the lapels 102, 103, but could be attached with any appropriate method, such as adhesive or heat bonding. Button openings 32 are formed through the stiffener strip 26 and the strip of material 30, such that a button 108 may be inserted through the button slits 104, 106.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A stiffener strip for a lapel of a garment, comprising:

a stiffener strip; and a strip retainer pocket being formed on an inner surface of the lapel with a strip of material, a perimeter of said strip of material is attached to the inner surface of the lapel, said perimeter including a top perimeter portion, a bottom perimeter portion, a first side perimeter portion and a second side perimeter portion, an inner perimeter of said top perimeter portion, said bottom perimeter portion, said first side perimeter portion and said second side perimeter portion form a strip cavity, said strip cavity is sized to receive an outer perimeter of said stiffener strip, at least one of said first side perimeter portion, said second side perimeter portion and said top perimeter portion includes a strip opening being located at a leg of a corner of said strip retainer pocket, said strip opening is sized to permit the insertion of said stiffener strip into said strip cavity, said strip opening is sized to permit the removal of said stiffener strip from said strip cavity, said strip of material covering all of said stiffener strip when inserted into said strip cavity, said strip retainer pocket being positioned to retain said stiffener strip below a collar of the garment.

2. The stiffener strip for a lapel of a garment of claim 1, further comprising:

said strip retainer pocket being formed by sewing said strip of material on to the inner surface of the lapel.

3. The stiffener strip for a lapel of a garment of claim 1, further comprising:

a strip storage pocket being formed on an inner surface of the lapel below said strip retainer pocket.

4. The stiffener strip for a lapel of a garment of claim 1 wherein:

said stiffener strip being fabricated from a stiff yet flexible material.

5. The stiffener strip for a lapel of a garment of claim 4 wherein:

said stiff yet flexible material being a plastic.

6. The stiffener strip for a lapel of a garment of claim 1, further comprising:

a second strip of material is attached to an inner surface of a button lapel to form a second strip retainer pocket, a second stiffener strip is retained in said second strip retainer pocket.

7. A stiffener strip for a lapel of a garment, comprising:

a stiffener strip; and a strip retainer pocket being formed on an inner surface of the lapel with a strip of material, a perimeter of said strip of material is attached to the inner surface of the lapel, said perimeter including a top perimeter portion, a bottom perimeter portion, a first side perimeter portion and a second side perimeter portion, an inner perimeter of said top perimeter portion, said bottom perimeter portion, said first side perimeter portion and said second side perimeter portion form a strip cavity, said strip cavity is sized to receive an outer perimeter of said stiffener strip, at least one of said first side perimeter portion, said second side perimeter portion and said top perimeter portion includes a strip opening being located at a leg of a corner of said strip retainer pocket, said strip opening is sized to permit the insertion of said stiffener strip into said strip cavity, said strip opening is sized to permit the removal of said stiffener strip from said strip cavity, said strip of material covering all of said stiffener strip when inserted into said strip cavity, at least one button opening is formed through said strip of material and said stiffener strip, said at least one button opening being substantially aligned with at least one button slit in the lapel, said strip retainer cavity being positioned to retain said stiffener strip below and adjacent a collar of the garment.

8. The stiffener strip for a lapel of a garment of claim 7, further comprising:

a second strip of material is attached to an inner surface of a button lapel to form a second strip retainer pocket, a second stiffener strip is retained in said second strip retainer pocket.

9. The stiffener strip for a lapel of a garment of claim 7 wherein:

said stiffener strip being fabricated from a stiff yet flexible material.

10. The stiffener strip for a lapel of a garment of claim 9 wherein:

said stiff yet flexible material being a plastic.

11. The stiffener strip for a lapel of a garment of claim 7, further comprising:

said strip retainer pocket being formed by sewing said strip of material on to the inner surface of the lapel.

12. The stiffener strip for a lapel of a garment of claim 7, further comprising:

a strip storage pocket being formed on an inner surface of one of the button hole lapel and button lapel below said strip retainer cavity.

* * * * *